United States Patent [19]

Longhurst

[11] Patent Number: 4,955,567

[45] Date of Patent: Sep. 11, 1990

[54] TOOTHBRUSH HOLDER FOR UPRIGHT TOOTHPASTE DISPENSER

[76] Inventor: Frank J. Longhurst, 127 N. Highland Rd., Springfield, Pa. 19064

[21] Appl. No.: 295,986

[22] Filed: Jan. 12, 1989

[51] Int. Cl.[5] ..... B65D 35/56

[52] U.S. Cl. ..... 248/108; 222/183

[58] Field of Search ..... 248/360, 108, 109; 211/13; 215/100; 222/180, 182, 183, 185; 206/229, 230

[56] References Cited

U.S. PATENT DOCUMENTS

| | | | |
|---|---|---|---|
| 3,100,065 | 8/1963 | Gross | 222/180 |
| 3,269,610 | 8/1966 | Fuls | 222/183 |
| 3,486,630 | 12/1969 | Ellman | 211/13 |
| 3,865,279 | 2/1975 | James | 222/182 |
| 4,615,476 | 10/1986 | Hobbs | 222/182 X |
| 4,776,492 | 10/1988 | Gallo | 222/183 |
| 4,778,084 | 10/1988 | Chen | 222/185 |

*Primary Examiner*—J. Franklin Foss

*Attorney, Agent, or Firm*—Laurence A. Weinberger

[57] ABSTRACT

This invention permits the dispensing of toothpaste onto a standard toothbrush using only one hand or limb and intended as an aid to disabled persons. The invention includes a toothpaste dispenser grasping member that fits over conventional commercially available upright toothpaste dispensers. A toothbrush holding tray is rigidly connected to the top of the toothpaste dispenser grasping member so that the bristles of a toothbrush placed on the toothbrush holding tray will be located below the nozzle of the toothpaste dispenser. To ensure that the bristles will be located properly under the nozzle, an alternative embodiment includes a toothbrush stop positioned on the toothbrush holding tray. The toothpaste grasping member may also have an opening in its side to allow one to view the window often placed in upright toothpaste dispenser to show how much toothpaste is left. Yet another embodiment includes a flared skirt rigidly attached to the base of the dispenser grasping member giving a wider footing for greater stability. An actuating lever arm may be pivotally attached to the dispenser grasping member to permit easier depression of the toothpaste dispensing button.

9 Claims, 2 Drawing Sheets

TOOTHBRUSH HOLDER FOR UPRIGHT TOOTHPASTE DISPENSER

BACKGROUND OF THE INVENTION

This invention relates to toothbrushes, toothpaste dispensers, and related articles of manufacture.

Although brushing one's teeth is normally a routine part of basic hygiene, few devices are available to help handicapped persons perform this basic daily function. In particular, the application of toothpaste to a toothbrush can be very difficult for persons who have suffered strokes, amputations, or who, for other reasons, have suffered either partial or total loss of use of a limb and/or hand. Hospital personnel and rehabilitative specialists still advise such persons to first squeeze toothpaste onto a sink top or other surface and then to scrape the toothpaste off the surface onto the brush. Despite its wide recommendation and use, this method is basically unsanitary and unacceptably leaves a caked residue on the surface which is difficult to remove. The alternative of laying the toothbrush upon the sink top or other surface and dispensing toothpaste upon it is similarly non-sanitary and difficult to accomplish without missing the brush even for a non-handicapped person. Further, disabled persons will often also have additional impairment of both limbs or hands making even more difficult the fine motor movements necessary to align and dispense toothpaste onto a toothbrush lying flat on a sink top. It may also be very difficult for disabled persons with weakened motor movement to firmly depress the dispensing top/button of the standard upright toothpaste dispenser.

In the prior art are toothbrush and toothpaste dispenser designs which would permit single handed loading of a toothbrush with toothpaste. However, either specialized toothbrushes and/or pressurized toothpaste dispensers are necessary. None of the prior art designs permits hygienic use of a standard toothbrush in conjunction with standard, readily, commercially available toothpaste dispensers. For instance, U.S. Pat. No. 4,717,278 by Jemeny teaches an apparatus in which a specially adapted toothbrush head screws onto a replaceable cylindrical toothpaste container. U.S. Pat. No. 3,612,706 by Verga teaches another specially adapted toothpaste dispensing toothbrush in which toothpaste from a pressurized container flows out from the back of the bristles. U.S. Pat. Nos. 3,022,789 and 3,825,354 by Rallis show specially adapted toothbrushes into which one can inject toothpaste from an aerosol can. Similarly, French Patent No. 73.16611 by Briand teaches an aerosol spray can of toothpaste with a toothbrush spring-clipped to its side. British Patent No. 1,181,305 by Field also shows a specially adapted toothbrush head designed to receive toothpaste or some other substance from a aerosol can.

Further removed still are U.S. Pat. Nos. 3,550,857 by Ahlberg and 2,907,358 by Armstrong. These patents disclose designs for spray can dispensers and toothpowder containers, respectively. None of the patents cited above anticipates or renders obvious the present invention.

SUMMARY OF THE INVENTION

The present invention is a toothbrush holder which, when used with a conventional toothbrush and the readily available upright toothpaste dispensers which are now on the market, allows a person to dispense toothpaste onto a toothbrush with a minimum of dexterity and coordination and utilizing only one hand or limb.

The invention consists of two primary elements: a toothpaste dispenser grasping member that fits over or around an upright toothpaste dispenser, and a toothbrush-holding side support or tray extending from the grasping member. In use, a standard toothbrush is placed upon the toothbrush tray with its bristled end adjacent to the nozzle of the upright toothpaste dispenser. Depression of the dispenser top button releases toothpaste onto the bristles.

In the preferred embodiment, the grasping member is a cylinder open at both endfaces. Because upright toothpaste dispensers often have a transparent area showing the amount of toothpaste remaining, the grasping member may have a slit or opening on its side so that the transparent section of the dispenser is visible. In an alternative embodiment, the grasping member may be transparent so that the brand markings and volume remaining of toothpaste may be easily observed.

The toothbrush holding tray extends from the topmost edge of the grasping member at a position adjacent to the nozzle of the upright toothpaste dispenser. The holding member may be concave or grooved in order to retain the toothbrush. For some toothbrushes and dispensers, an integral toothbrush stop may be located near the dispenser grasping end of the toothbrush tray to properly position the bristles under the dispenser nozzle. In one alternative embodiment, to further stabilize the toothpaste dispenser from accidentally being knocked over, the base of the dispenser grasping member may be enlarged to provide a greater area of contact with the supporting surface. In a further preferred embodiment, an actuating lever providing mechanical advantage may be pivotally attached to the dispenser grasping member so that a larger surface which is more easily engaged will be available to the handicapped person to depress the toothpaste dispensing button.

Accordingly, it is a first object of this invention to provide an apparatus that allows a disabled person to load a standard toothbrush with toothpaste.

A second object of this invention is to provide an apparatus that may be easily used with an upright toothpaste dispenser.

A third object of this invention is to provide an apparatus that helps prevent an upright toothpaste dispenser from being tipped over from its upright position.

BRIEF DESCRIPTION OF THE DRAWINGS

Further objects of the invention will become apparent by review of the attached drawings in FIGS. 1 to 5, described below.

DETAILED DESCRIPTION OF INVENTION

Figure 1:
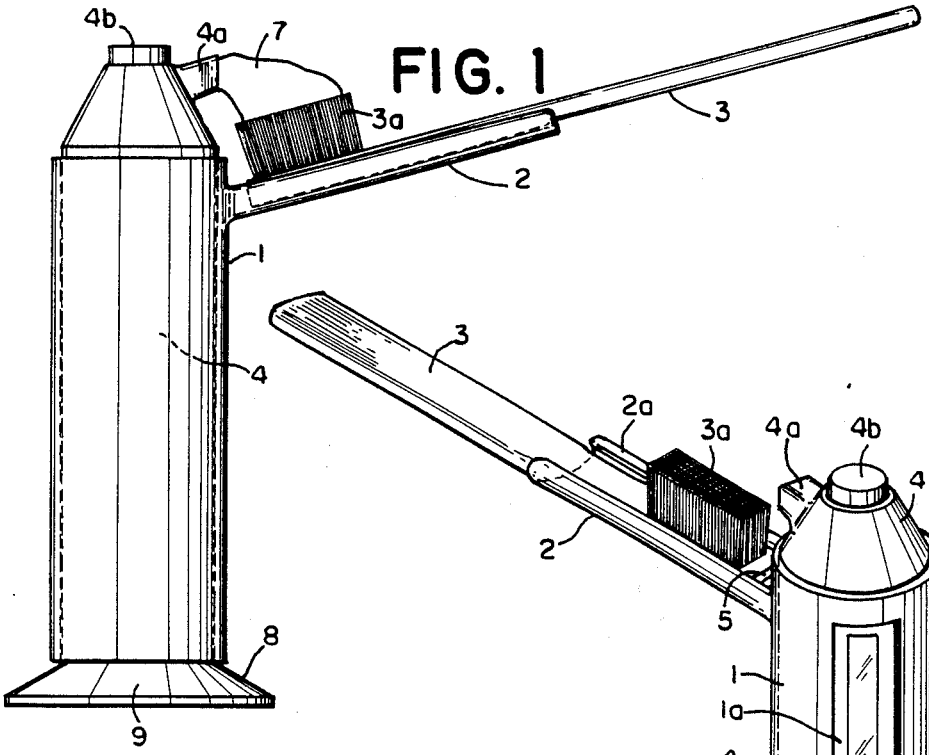
FIG. 1 is a side view of the invention as used with an upright toothpaste dispenser showing a standard toothbrush in position to receive toothpaste.
Figure 2:
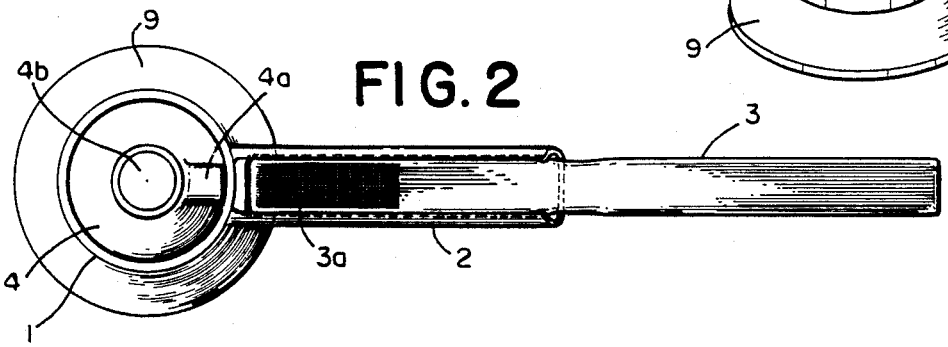
FIG. 2 is a top view of the invention shown in FIG. 1.

FIG. 1 shows the invention as it would be actually used. As shown, the dispenser grasping member 1 is largely cylindrical, fits over the upright toothpaste dispenser 4, and rests on the top surface 8 of flared base support 9 of dispenser 4. Attached to the side of the dispenser grasping member 1 is the toothbrush holding tray 2. The toothbrush tray 2 is preferably formed as an integral part of the dispenser grasping member 1. The toothbrush holding tray 2 is so located along the longer dimension of the dispenser grasping member 1 that, when a toothbrush 3 is placed upon toothpaste holding tray 2, the bristle section 3*a* of toothbrush 3 is positioned at the correct height to receive toothpaste 7 from the dispenser nozzle 4*a* when dispenser button 4*b* is depressed. In the preferred embodiment, the toothbrush holding tray 2 has a concave cross section so that the toothbrush is retained by the concave walls of the tray 2 thereby preventing sideways movement of the toothbrush off of the tray. FIG. 2 shows that the diameter of the dispenser grasping member 1 must be larger than the diameter of the dispenser 4. In addition, the diameter of dispenser grasping member 1 must be sufficient to allow the dispensing grasping member 1 to easily slide over dispenser 4. To prevent the toothbrush from falling, the toothbrush holding tray 2 must be of sufficient length so that the center of gravity of toothbrush 3 rests over part of toothbrush tray 2. In use, the dispenser grasping member is lowered down over the top of the toothpaste dispenser 4 and rotated about the long axis down the center of the cylinder so that the toothbrush tray 2 extends in the same direction as the toothbrush dispensing nozzle 4*a* so that dispensing of toothpaste results in the toothpaste landing on bristles 3*a* of toothbrush 3.

Figure 3:
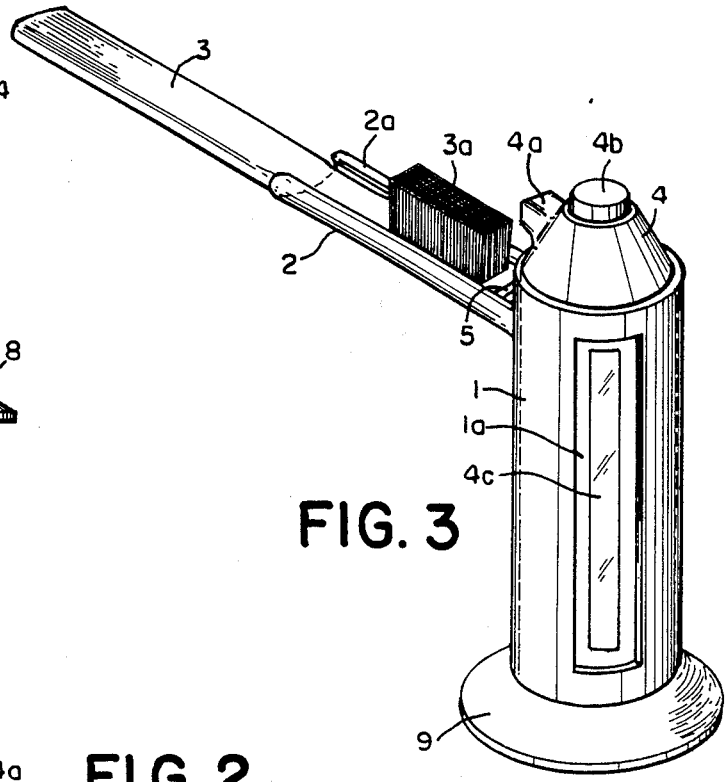
FIG. 3 is a perspective view of an alternative embodiment showing a viewing slit or opening in the side of the dispenser grasping member and a stop along the toothbrush support tray.

FIG. 3 shows an alternative embodiment of the present invention. In this embodiment, a slot or opening 1*a* is shown positioned so that when toothbrush tray 2 is properly aligned so that toothpaste from nozzle 4*a* will fall on bristles 3*a*, the toothpaste volume indicating window 4*c* in the side of the dispenser 4 will be visible through opening 1*a*. FIG. 3 also shows a toothbrush stop 5 incorporated in toothbrush tray 2. The purpose of toothbrush stop 5 is to provide a stop against which the end of toothbrush 3 rests so that the bristles 3*a* are properly aligned to receive the toothpaste from dispenser nozzle 4*a*. In the preferred embodiment the toothbrush stop 5 is integrally formed as a part of toothbrush tray 2. FIG. 3 also shows toothbrush tray 2 formed with a concave cross section and extended walls 2*a* in order to retain the toothbrush 3.

Figure 4:
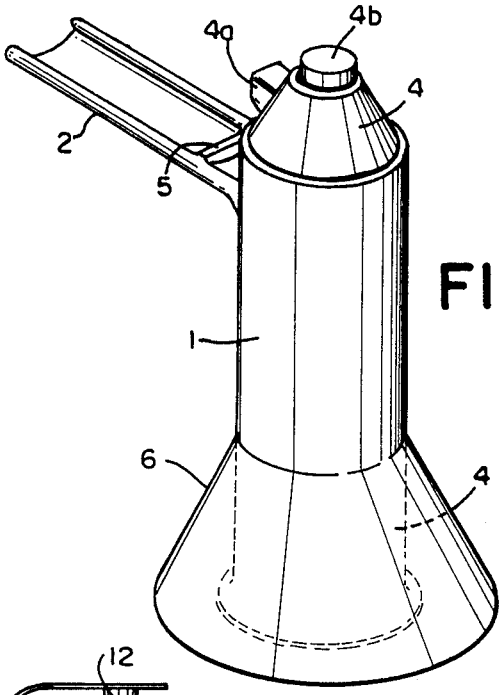
FIG. 4 is a perspective view of an alternative embodiment showing a widened stabilizing base.

FIG. 4 shows an alternative embodiment that takes into consideration the fact that many handicapped persons do not have fine motor control of their hands or limbs which will result in their easily knocking over the standard upright toothpaste dispenser. In this embodiment, the lower end of the dispenser grasping member 1 has been flared to form a large rigid skirt 6 which extends obliquely from dispenser grasping member 1. The purpose of the skirt 6 is to give the dispenser grasping member 1 a wider footing or contact area thereby providing greater stability against any accidental tippage. Like toothbrush holding tray 2, skirt 6 is rigidly connected to dispenser grasping member 1. In the preferred embodiment, the skirt 6 is integrally formed as part of dispenser grasping member 1. Also shown in FIG. 4 is the toothbrush stop 5.

Figure 5:
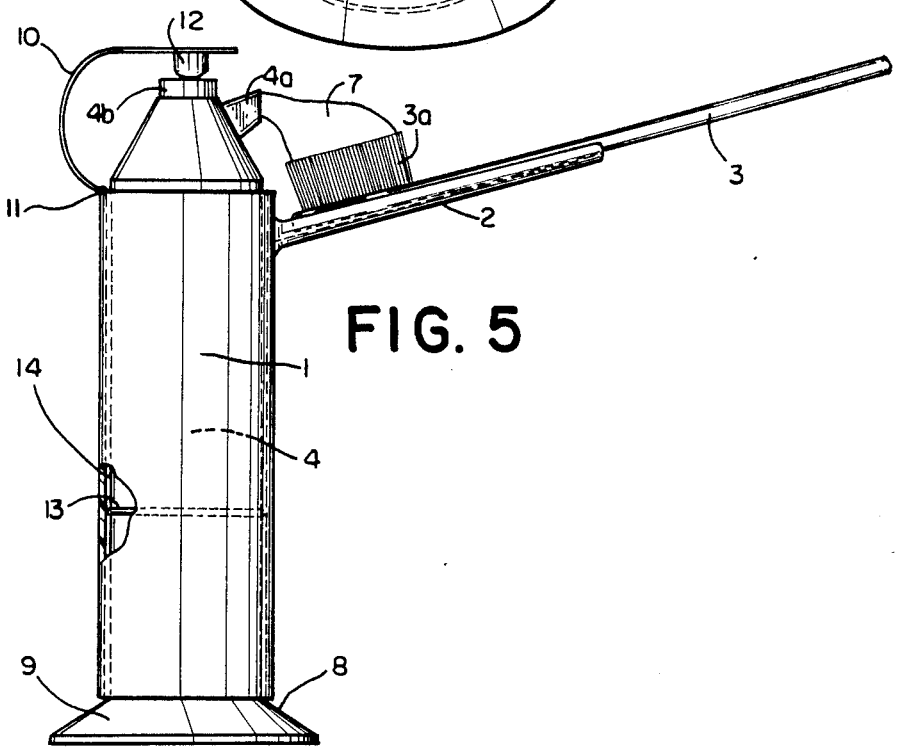
FIG. 5 is a side view of the invention showing an actuating lever.

FIG. 5 shows the actuating lever 10 pivotally attached at 11 to the dispenser grasping member 1. The actuating lever 10 has attached to its underside a depressing knob 12 so positioned that, when actuating lever 10 is depressed, knob 12 is forced downward onto the toothpaste dispensing button 4*b*. The actuating lever 10 provides a larger, more easily manipulated surface to be depressed by disabled persons and also provides additional mechanical advantage to aid in depressing the toothpaste dispensing button 4*b*. To prevent the dispenser grasping member 1 from rising upward as actuating lever 10 is pushed down, a flexible O ring 13 slightly larger than the space 14 between dispenser grasping member 1 and dispenser 4 may be placed around toothpaste dispenser 4 prior to placing dispenser grasping member 1 over dispenser 4. The flexible O ring 13 frictionally engages dispenser grasping member 1 and dispenser 4 to prevent relative movement between dispenser grasping member 1 and dispenser 4 when actuating lever 10 is depressed.

It should be appreciated that in the spirit of the invention, it is not necessary that dispenser grasping member 1 be a solid cylinder but may, in fact, be slotted or only consist of encircling arms sufficient to grasp toothpaste dispenser 4, without falling outside of the scope of this invention. In a preferred embodiment, the invention would be constructed of a sterilizable plastic material which could be easily cleaned. It should be recognized that the invention provides the same advantages for use by small children as well as by handicapped individuals. Further, the invention may be used on other types of pressurized or non-pressurized dispensing containers, such as men's shaving cream containers, to enable the handicapped to more easily dispense the contents of those containers. For instance, for use with shaving cream dispensers, the tray would be shortened and broadened to receive the cream. These and other variations are anticipated without departing from the spirit and scope of the disclosed invention. It should be evident that, for the handicapped person, any human appendage which may be used both to place toothbrush 3 on toothbrush holding tray 2 and to depress toothpaste dispensing button 4*b* may be used with the present invention. Thus, it is anticipated that those individuals who may not have use of their arms or hands but may have use of their feet may also make use of the invention. Also, unlike the currently recommended method of placing toothpaste on a sink, the present invention does not result in caked material remaining on sink tops presenting yet further problems for the handicapped to clean up. Finally, any of the almost infinite variety of standard toothbrushes may be used with this invention without further modification.

What is claimed is:

1. An apparatus enabling easier loading of a toothbrush with toothpaste, which comprises:
   (a) means for grasping an upright toothpaste dispenser; and
   (b) means for holding a toothbrush, wherein said toothbrush holding means are rigidly attached to an edge of said dispenser grasping means and extend radially outward from said dispenser grasping means, so that a toothbrush placed in said toothbrush holding means may receive toothpaste from the nozzle of the upright toothpaste dispenser.

2. The apparatus of claim 1, wherein said dispenser grasping means comprise a cylinder without endfaces that engages the side of the upright toothpaste dispenser.

3. The apparatus of claim 1 or claim 2, wherein said dispenser grasping means has an opening therein, allowing one to view a transparent portion of the upright toothpaste dispenser.

4. The apparatus of claim 1 or 2, wherein said grasping means is transparent.

5. The apparatus of claim 1, wherein said toothbrush-holding means comprise a concave member extending from said dispenser grasping means.

6. The apparatus of claim 1 or 2, further comprising a conical skirt attached to said dispenser grasping means at an end opposite the end where the dispenser nozzle is located when the apparatus is placed over upright toothpaste dispenser.

7. The apparatus of claim 1, further comprising a stop attached to said toothbrush holding means, so that a toothbrush placed in said holding means abuts said stop at a position where the bristles of the toothbrush are adjacent the nozzle of the upright toothpaste dispenser.

8. An apparatus enabling easier loading of a toothbrush with toothpaste, which comprises:

(a) means for grasping an upright toothpaste dispenser; and (b) means for holding a toothbrush, wherein said toothbrush holding means are rigidly attached to an edge of said dispenser grasping means and extend radially outward from said dispenser grasping means, so that a toothbrush placed in said toothbrush holding means may receive toothpaste from the nozzle of the upright toothpaste dispenser.

(c) an actuating lever arm pivotally attached to the dispenser grasping means wherein movement of the actuating lever arm towards the dispenser grasping means depresses the toothpaste dispenser button on an upright toothpaste dispenser.

9. The apparatus of claim 8 wherein a frictional engaging means prevents the dispenser grasping means from moving relative to the upright toothpaste dispenser when the actuating lever is moved towards the dispenser grasping means.

* * * * *